US006402432B1

(12) United States Patent
England et al.

(10) Patent No.: US 6,402,432 B1
(45) Date of Patent: Jun. 11, 2002

(54) METHOD FOR INSTALLING LOAD BEARING PILES UTILIZING A TOOL WITH BLADE MEANS

(75) Inventors: Melvin Gerard England, Middlesex; Wilfred George Kenneth Fleming, Chorleywood; Roger Martin Darke, Worcester, all of (GB)

(73) Assignee: Kvaerner Cementation Foundations Limited, Rickmansworth (GB)

( * ) Notice: Subject to any disclaimer, the term of this patent is extended or adjusted under 35 U.S.C. 154(b) by 0 days.

(21) Appl. No.: 09/529,364

(22) PCT Filed: Nov. 13, 1998

(86) PCT No.: PCT/GB98/03419

§ 371 (c)(1),
(2), (4) Date: Apr. 6, 2000

(87) PCT Pub. No.: WO99/25930

PCT Pub. Date: May 27, 1999

(30) Foreign Application Priority Data

Nov. 13, 1997 (GB) ..... 9724024

(51) Int. Cl.[7] ..... E02D 13/00; E02D 5/44

(52) U.S. Cl. ..... 405/232; 405/231; 405/233; 405/237; 175/267; 52/155

(58) Field of Search ..... 405/231, 232, 405/233, 237, 238, 239; 175/267; 248/545; 40/606, 607; 52/155, 156, 157, 158, 159, 160

(56) References Cited

U.S. PATENT DOCUMENTS

| | | | | | |
|---|---|---|---|---|---|
| 987,266 | A | * | 3/1911 | Smith | 175/9 |
| 3,191,390 | A | * | 6/1965 | Schutte | 405/238 |
| 3,394,766 | A | * | 7/1968 | Lebelle | 175/55 X |
| 3,869,003 | A | * | 3/1975 | Yamada et al. | 175/171 |
| 3,969,853 | A | * | 7/1976 | Deike | 52/156 |
| 4,411,557 | A | * | 10/1983 | Booth | 405/238 |
| 4,547,106 | A | * | 10/1985 | Lipsker | 405/237 X |
| 4,626,138 | A | | 12/1986 | Boyles | |

(List continued on next page.)

FOREIGN PATENT DOCUMENTS

| | | | | |
|---|---|---|---|---|
| DE | 1634 449 | | 8/1970 | |
| EP | 0 003 063 | | 7/1979 | |
| EP | 0 370 396 | | 5/1990 | |
| EP | 0 758 699 | | 2/1997 | |
| GB | 1 561 183 | | 2/1980 | |
| GB | 2 108 185 | | 5/1983 | |
| GB | 2 217 366 | | 10/1989 | |
| GB | 2222621 | * | 3/1990 | 405/237 |
| GB | 2 248 082 | | 3/1992 | |

(List continued on next page.)

*Primary Examiner*—H. Shackelford
*Assistant Examiner*—Jong-Suk Lee
(74) *Attorney, Agent, or Firm*—Herbert Dubno

(57) ABSTRACT

A method and apparatus for installing a pile or load-bearing element into soft ground, wherein a non-percussive force, rather than a percussive force such as that applied by a hammer or a jack, is applied to the top of a hole-forming tool or pile (1) so as to push the hole-forming tool or pile (1) in a substantially continuous motion to a first depth into the ground, and wherein the hole-forming tool or pile (1) is then pushed in a non-percussive manner to a second depth while being simultaneously rotated. A cast-in-situ pile is formed in soft ground by pushing a hole-forming tool (1) provided with fins (3) at its base into the ground. Once the required level has been reached, the hole-forming tool (1) is rotated and concrete or grout is pumped through the body of the hole-forming tool so as concomitantly to help displace and replace the soil swept away by the fins (3). The hole-forming tool (1) is then withdrawn, and further concrete or grout is supplied so as to form a predictably-shaped pile with enhanced bearing capacity.

23 Claims, 8 Drawing Sheets

U.S. PATENT DOCUMENTS

| | | | | | |
|---|---|---|---|---|---|
| 5,028,166 | A | * | 7/1991 | Leishman | 405/231 X |
| 5,082,231 | A | * | 1/1992 | Knowles | 248/545 |
| 5,122,013 | A | * | 6/1992 | Junsheng et al. | 405/237 |
| 5,186,582 | A | * | 2/1993 | Bullivant | 405/239 X |
| 5,219,246 | A | * | 6/1993 | Coutts et al. | 405/237 |
| 5,219,249 | A | * | 6/1993 | Junshen et al. | 405/237 X |
| 5,503,501 | A | * | 4/1996 | Kunito | 405/237 X |
| 5,620,277 | A | * | 4/1997 | Cole, Sr. et al. | 404/10 |
| 5,669,736 | A | * | 9/1997 | Lin | 405/233 |

FOREIGN PATENT DOCUMENTS

| | | |
|---|---|---|
| GB | 2 260 776 | 4/1993 |
| GB | 2 293 850 | 4/1996 |
| GB | 2 303 868 | 3/1997 |
| JP | 2000303457 | * 10/2000 |
| JP | 2000303460 | * 10/2000 |
| WO | 90/02243 | 3/1990 |
| WO | 94/02687 | 2/1994 |
| WO | 95/12050 | 5/1995 |
| WO | 97/05334 | 2/1997 |

* cited by examiner

METHOD FOR INSTALLING LOAD BEARING PILES UTILIZING A TOOL WITH BLADE MEANS

CROSS REFERENCE TO RELATED APPLICATIONS

This application is a national stage of PCT/GB98/03419 filed Nov. 13, 1998 and based upon the U.K. national application UK 9724024.6 filed Nov. 13, 1997 under the International Convention.

FIELD OF THE INVENTION

The present invention relates to a method and apparatus for installing a pile and/or a concrete or grout column in the ground, in particular by way of soil displacement.

BACKGROUND OF THE INVENTION

It is known to install load-bearing piles or columns by various methods. A first method involves hammering a preformed pile into the ground in a series of discrete steps. This method can be effective, but there is a risk of causing damage to the pile or to the ground due to the discontinuous hammering action. Furthermore, much noise and vibration is caused by hammering. An alternative method is to use a jack to install a pile or column made up of a number of discrete sections. A first section is pushed into the ground by the jack, which is then reset, and a second section is then welded or bonded to the top of the first section. The jack is then activated again, and the process repeated until the required depth has been reached. This method is low in efficiency since the jack needs to be retracted after completing each single stroke so that the next element of the pile can be inserted, particularly since a typical stroke length is less than 50 cm.

A second known method is continuous flight auger piling, in which an auger with a continuous flight is caused to enter the ground by way of rotation. Soil is excavated by way of the auger flights before or during the time that the auger is withdrawn from the ground. As the auger is being withdrawn, concrete is pumped through the stem of the auger to the tip, thereby leading to the formation of a load-bearing pile or column. Such a method is described in the present applicant's U.K. patent application no. 9515652.7, the disclosure of which is incorporated into the present application by reference.

Alternatively, as disclosed for example in WO 95/12050, it is possible to use an auger head which does not excavate soil, but instead displaces the soil and compacts it into the surrounding ground. This has the advantage that less spoil is generated, and can lead to better maintenance of ground integrity and greater density in the vicinity of the pile installation.

However, both these methods require that an auger or similar device be screwed into the ground, which takes a relatively long time and generally means that specific combinations of torque and thrust must be applied in accordance with the ground conditions in order to achieve penetration, and these can be difficult to achieve. Another disadvantage with these screw piling methods is that the piling tool is subjected to a large degree of wear. Furthermore, we have found that there appears to be an inverse relationship between the rotational torque required to produce downward thrust by way of the pitch of the auger flights and the "crowd force" (i.e. the total force applied along the longitudinal axis of the auger during penetration) generated at the rig which can be used to achieve penetration into the ground. Indeed, the crowd force in itself is not sufficient to achieve the desired penetration, particularly when premature resistance to penetration, e.g. caused by the presence of a subterranean stratum of granular material such as gravel, is experienced.

SUMMARY OF THE INVENTION

According to a first aspect of the present invention, there is provided a method of installing a load-bearing pile or column in the around, wherein:

i) a hole-forming tool or pile having a longitudinal axis is pushed into the ground, substantially in the direction of its longitudinal axis, in a substantially non-percussive manner to a first depth; and ii) the hole forming tool or pile is then pushed further into the ground, substantially in the direction of its longitudinal axis, in a substantially non-percussive manner to a second depth while being rotated about its longitudinal axis.

The term "non-percussive" is to be understood as the application of a substantially continuous force over a relatively protracted period of time, e.g. over a number of seconds or even minutes. This is to be distinguished from percussive methods of piling, in which, for example, a weight is repeatedly dropped onto the top of a pile so as, in effect, to hammer the pile into the ground. In this case, most of the force is applied over a relatively short period of time, e.g. fractions of a second. Furthermore, the rate of change of applied force with respect to time will, in practical terms, generally have a discontinuity, as opposed to non-percussively applied force, which will tend to have a rate of change with respect to time which is substantially continuous.

The present invention is of particular use when installing or forming piles in soft ground overlying a granular stratum, such as gravel or the like. The rotational motion of the hole-forming tool or pile helps to overcome premature resistance to penetration which may otherwise prevent the attainment of desired depths. Generally, the hole-forming tool or pile is pushed into the soft overlying soil until it reaches the granular stratum, at which point the hole-forming tool or pile is additionally rotated. Rotation combined with the pushing force is surprisingly effective in penetrating granular strata, especially with certain hole-forming tool or pile tip geometries, and enables the resulting pile to be well-founded.

The rotation may be continuous rotation in either direction; alternatively or in addition, back and forth rotation may be used, which rotation may be less than or more than one revolution. Where back and forth rotation is used, it has been found that an oscillation frequency of around 1 Hz is effective in aiding penetration of granular strata, although frequencies of an order of magnitude higher or lower, e.g. around 10 Hz to 0.1 Hz, are also envisaged. In some applications, even higher or lower frequencies, e.g. around 100 Hz to 0.01 Hz, may be useful.

This method may be used either to install a pile, such as a steel or pre-cast concrete pile, directly into the ground, or may be used to insert a hole-forming tool, such as a hollow cylindrical tube provided with a sacrificial end plate, into the ground so as to allow a load-bearing concrete or grout column to be cast-in-situ prior to or during removal of the tool. The pile or tool dimensions and the force applied to the pile or tool are advantageously determined in accordance with the ground conditions.

Preferably, the hole-forming tool or pile is pushed in a continuous motion to a given depth of at least 1 m into the ground, and in some applications, at least 2 m or even 5 m into the ground. Once the given depth has been reached, the continuous force may be reapplied one or more times so as to push the hole-forming tool or pile to a greater given depth, such as the depth of a granular stratum.

In this way, we have found that it is possible in certain ground conditions to attain depths in excess of 5 m in a time of around 16 seconds, as opposed to 4 minutes using a rotating auger.

According to a second aspect of the present invention, there is provided a method of boring into the ground, wherein:

i) a hole-forming tool having a longitudinal axis is pushed into the ground, substantially in the direction of its longitudinal axis, in a substantially non-percussive manner to a first depth; and ii.) the hole-forming tool is then pushed further into the ground, substantially in the direction of its longitudinal axis, in a substantially non-percussive manner to a second depth while being rotated about its longitudinal axis.

The hole-forming tool is generally withdrawn from the ground after it has reached the required depth, although in some applications the tool may be sacrificed and left in the ground.

In some embodiments, the hole-forming tool has a generally pointed tip, since this can be effective in penetrating granular strata when pushed into the ground with concomitant rotation. However, a particularly preferred embodiment utilises a hole-forming tool with a generally flat base. We have found that upon pushing such a flat-based tool into the ground, soil under the flat base tends to be compressed into a cone of relatively higher density than the surrounding soil. This cone of relatively high density soil substantially stays with the base of the hole-forming tool during penetration and rotation, and serves to disturb the underlying soil in the desired manner. In some applications, it is advantageous to spread a carpet of gravel or other granular material on the top of the ground prior to penetration of the hole-forming tool. The flat-based hole-forming tool is then lowered onto the carpet of gravel or other granular material and pushed into the ground, thereby using the gravel or granular material to make up at least some of the resulting cone. Although a proportion of the soil and/or gravel or other granular material forming the cone of relatively high density may be lost to the surrounding soil, this proportion is usually relatively low, and in any case will generally be replaced by soil underlying the base of the hole-forming tool.

A pushing force is applied to the hole-forming tool in a similar manner to that described in relation to the other aspects of the present invention, as is the rotation. Advantageously, the magnitude and duration of the applied non-percussive force, as well as those of the torque applied to generate rotation, are monitored and controlled by electronic computer means.

According to a third aspect of the present invention, there is provided a rig for inserting a hole-forming tool or pile having a longitudinal axis into the ground, wherein the rig is provided with first means for applying a substantially non-percussive force to the hole-forming tool or pile so as to push this into the ground, substantially in the direction of its longitudinal axis, to a first depth, and wherein the rig is further provided with second means for applying a rotation to the hole-forming tool or pile about its longitudinal axis, so as, in combination with said first means, to push the hole-forming tool or pile, substantially in the direction of its longitudinal axis, in a substantially non-percussive manner to a second depth.

Preferably, the rig is adapted to push the hole-forming tool or pile in a continuous motion to a given depth of at least 1 m, and in some applications, at least 2 m or even 5 m into the ground. Once the given depth has been reached, the continuous force may be reapplied one or more times so as to push the hole-forming tool or pile to a greater given depth, e.g. that of a granular stratum, before the hole-forming tool or pile is rotated.

One feature of the present invention is that the substantially non-percussive pushing force applied directly to the hole-forming tool or pile is greater than the downwards forces which may be generated by rotation of the hole-forming tool or pile. This is in complete contrast to screw piling methods, in which a substantial downwards force is generated due to the reaction between the helical rotating auger flight and the soil, especially in dense, cohesive soils. Advantageously, the directly-applied force is at least two, and preferably at least five times greater in magnitude than the incidental downwards force which may be generated by rotation.

By way of the present invention, it is possible to make use of a good proportion of the weight of a typical piling rig, for example 70 tonnes, to help push. a hole-forming tool or pile into the ground. Given no constraints on the piling rig abilities, we have found that it is relatively straightforward to generate substantially only a downward force to achieve penetration of the hole-forming tool or pile. The limitations to this process are determined by the forces presented as resistance to penetration, and several fundamental factors need to be considered:

i) The resistance to penetration into the ground is dependent on the specific ground conditions and soil type.

ii) the resistance is proportional to the cross-sectional area of the element being inserted, and therefore the smaller the cross section, the lower the downward force required.

iii) The maximum downward force cannot exceed that available from the piling rig used to install the hole-forming tool or pile.

An advantage of the present invention is that once the skin friction is overcome upon penetration, the resistance experienced by the hole-forming tool or pile during motion is often less than the static resistance which may be encountered when the hole-forming tool or pile has been left undisturbed for a period during which soil "set-up" occurs.

It may sometimes be advantageous to apply vibration to the hole-forming tool or pile so as to reduce skin friction in the event that penetration is interrupted, but in any case the downward forces generated by such vibration will be significantly less than those required to insert the hole-forming tool or pile to a greater depth. Vibration may also be used as an aid to the expeller head should any obstructions impede its penetration into the ground.

The non-percussive force applied by the rig to the top of the hole-forming tool or pile may be provided by way of a weight adjustably suspended thereover. Alternatively or in addition, the rig may be provided with a winch arrangement which is adapted to pull down the top of the hole-forming tool or pile.

In a particularly preferred embodiment, the rig is provided with a hydraulic ram with an extension of at least 1 m, and preferably at least 2 m or in some embodiments at least 5 m. Such a ram may be used to apply a non-percussive downwards force to the top of the hole-forming tool or pile so as to achieve depths of, respectively, at least 1 m, 2 m or 5 m in a single operation. The ram may then be reset and arranged to reapply the non-percussive force so as to achieve even greater depths. Additionally, the ram may be used in conjunction with a suspended weight and/or a winch arrangement and/or a vibrator.

Rotations may be applied by way of an electric, hydraulic or pneumatic motor, or by any other suitable means, including manual means.

Where a hole-forming tool is pushed into the ground, concrete or grout may be pumped from the surface so as to emerge at; or near the tip of the tool as the tool is rotated and/or withdrawn. In this way, a cast-in-situ pile is formed. Advantageously, the volume of concrete or grout being pumped along the length of the hole-forming tool is monitored, for example by way of an electromagnetic flowmeter, and controlled by flow control means and electronic computer means. The electronic computer means additionally monitors and controls the rotation and/or the extraction of the hole-forming tool. In this way, it is possible to control the rate of rotation and/or withdrawal of the hole-forming tool as a function of concrete or grout flow, or vice versa, so as to help ensure that the resulting cast-in-situ pile is structurally sound.

According to a fourth aspect of the present invention, there is provided a method of forming an underground cast-in-situ pile, wherein:

i) a hole-forming tool comprising a body having a longitudinal axis and a lower end to which is fitted at least one blade-like attachment which extends beyond the diameter of the body is pushed into the ground, substantially in the direction of its longitudinal axis, in a substantially non-percussive manner to a first depth;

ii) at least the lower end of the hole-forming tool on which the at least one blade-like attachment is mounted is rotated in such a way that the at least one blade-like attachment displaces soil at or close to the base of the hole-forming tool while concrete or grout is concomitantly pumped along the length of the hole-forming tool so as to assist the blade-like attachments in the displacement of soil and to generate a base for the resulting pile; and iii) the hole-forming tool is withdrawn while concrete or grout continues to be pumped along the length of the hole-forming tool.

Preferably, the hole-forming tool is pushed in a continuous motion to a given depth of at least 1 m into the ground, and in some applications, at least 2 m or even 5 m into the ground. Once the given depth has been reached, the continuous force may be reapplied one or more times so as to push the hole-forming tool to a greater given depth.

The hole-forming tool used in this aspect of the invention is particularly suited to soft ground conditions, such as soft clay overlying sands, silts overlying gravels and any generally soft material overlying granular material or suitable rock or bedrock, and is used to install a pile which can transfer load from ground level to stiffer soils at depth.

The hole-forming tool is pushed into the ground until its base reaches the required depth, which will typically be the top of a loose to medium dense sand or granular layer or rock or bedrock. A vibrator may be applied to the top of the hole-forming tool in order to aid penetration through any sand lenses or stiff layers or the like which may be encountered before the tip of the hole-forming tool reaches the required founding level. The vibrator power may be of the order of 15 bhp, although any suitable power rating may be chosen in accordance with ground conditions. It is to be noted that the vibrator is not the key to penetration of the tool, but may be provided merely as a secondary means of achieving penetration into non-cohesive soils. The vibrator may also be used to assist with the extractions of the hole-forming tool.

Alternatively or in addition, the hole-forming tool may be rotated about its longitudinal axis without concrete or grout being pumped, while being pushed into the ground in a substantially non-percussive manner. The rotation may be continuous rotation in a given direction, or may be back and forth rotation as described with reference to the first aspect of the present invention. This rotational movement, when combined with a substantially non-percussive pushing force, allows the hole-forming tool to penetrate the layer or layers of sand or granular material. The rotational movement of the hole-forming tool results in the displacement of soil by the blade-like attachments. As a result of this displacement, ground pressure around the base of the hole-forming tool is lowered, thereby allowing material under the base of the hole-forming tool to move upwards, thereby causing the ultimate end bearing to fail at a much reduced loading.

Once at the required depth the hole-forming tool, or at least the section of the hole-forming tool on which the at least one blade-like attachment is mounted, is rotated in such a way that the at least one blade-like attachment displaces soil at the base of the hole-forming tool, advantageously aided by the pressure of the concrete or grout pumped to the base of the hole-forming tool. As the soil is displaced, it is concomitantly replaced by concrete or grout which may be pumped at positive pressure, for example up to 4 bar or even higher, through the body of the hole-forming tool and emerge from at least one aperture provided behind the at least one blade-like attachment or from at least one aperture provided at or near the tip of the tool, thereby forming a subterranean bulb of concrete or grout: of predictable shape. It is to be noted that as the hole-forming tool is rotated, soil in front of each blade-like attachment is compressed, thereby increasing the local soil pressure relative to the surrounding soil pressure. Correspondingly, soil behind each blade-like attachment is allowed to expand, thereby decreasing the local soil pressure relative to the surrounding soil pressure. Alternatively, in embodiments where the body of the hole-forming tool is solid, concrete or grout may be pumped through a separate feed pipe or pipes. Once the bulb has been formed, the hole-forming tool is extracted, preferably without rotation and preferably in the same orientation as that used during insertion so as to keep resistance to extraction low. In some embodiments, the at least one blade-like attachment may be arranged in a helical configuration about the body of the hole-forming tool. This means that the hole-forming tool may be withdrawn with rotation, provided that the rate of withdrawal is controlled as a function of the pitch of the helix and/or the change of depth and/or the rate of rotation. During extraction, further concrete or grout is delivered so as to form a continuous shaft up to a predetermined level. The delivery of concrete or grout during extraction must be sufficient to ensure that at least a predetermined minimum cross-section of shaft is cast. It is to be noted that with displacement piling tools such as the hole-forming tool hereinbefore described, the soil surrounding the tool will tend to plug any escape path for concrete or grout; consequently, the positive pressure of the concrete or grout can generally be maintained. If the tool is rotated while the concrete or grout pressure is maintained generally constant, then concrete or grout is absorbed into the area surrounding the fins and the original soil is displaced until eventually, after several rotations, substantially all of the original soil is successfully displaced and replaced with concrete or grout. This is readily signalled by a significant drop in the torque required to rotate the tool.

Advantageously, the volume of concrete or grout being pumped during formation of the base and shaft of the cast-in-situ pile is monitored, for example by way of an electromagnetic flowmeter, and controlled by electronic computer means. The electronic computer means may also be adapted to monitor and control the insertion and/or rotation and/or extraction of the hole-forming tool. For example, given the area of the at least one blade-like attachment and the rate of rotation, it is possible to program the electronic computer means to calculate the rate at which the soil is displaced, and consequently to calculate the rate at which concrete or grout should be pumped so as to help ensure that the resulting load-bearing pile or column is structurally sound. The electronic computer means is advantageously adapted to control the rate at which concrete or grout is pumped and/or the rate of rotation of the hole-forming tool in accordance with these calculations. The electronic computer means may additionally be adapted to monitor and control withdrawal of the hole-forming tool and the flow of concrete or grout during extraction so as to ensure that sufficient concrete or grout is supplied.

By displacing the soil at the base of the hole-forming tool and concomitantly injecting concrete or grout, the base of a cast-in-situ pile with enhanced bearing capacity is formed. The enhanced bearing capacity is a result of the increased diameter of the base of the pile relative to the shaft of the pile. The diameter of the base may be several times the diameter of the shaft.

The number of blade-like attachments mounted on the hole-forming tool is preferably two, for reasons of symmetry, but other numbers of attachments may be just as effective. The minimum number of rotations required to achieve the necessary soil displacement is 1/(number of attachments), provided that the attachments are equiangularly spaced about the circumference of the hole-forming tool, although depending on ground conditions, a greater number of rotations may be required so as to ensure that the soil is fully displaced. In some embodiments, the hole-forming tool is rotated first in one direction, and then in the other direction. The rate of rotation is advantageously controlled so that the volume of soil displaced is less than, or at least equal to, the volume of concrete concomitantly supplied.

In a particularly preferred embodiment, the volume of soil displaced is between 50 and 500 litres (0.05 to 0.5 $m^3$), which is relatively efficient in terms of material usage. Additional rotations and additional concrete or grout delivery may also be used in order to increase the size of the bulb, but this may not be of great advantage since the final shape of the bulb may no longer be as predictable and the effective area of the bulb may not increase.

Conventional drive means, such as a motor or even manual means, may be employed to rotate the hole-forming tool. Alternatively, one or more hydraulic rams may be used to rotate the hole-forming tool in a step-wise manner. The one or more hydraulic rams are adapted to engage with arms projecting axially from the body of the hole-forming tool, thereby providing step-wise rotation with a force great enough to ensure that the blade-like attachments displace the soil surrounding the lower end of the hole-forming tool. In a hole-forming tool with two diametrically opposed blade-like attachments, rotation through at least 180° is required, whereas in a hole-forming tool with four equally-spaced blade-like e attachments, rotation need only be through at least 90°.

The blade-like attachments are preferably sized and shaped so as not to deform excessively upon rotation. The blade-like attachments may be solid, or they may be provided with holes or apertures which enable the concrete or grout to be mixed in-situ with soil materials. Alternatively, each blade-like attachment may comprise several protruding elements separated by slits. The precise dimensions and shapes of the blade-like attachments may be selected in accordance with the ground conditions. In some embodiments, it is envisaged that the blade-like attachments may be disposed at an angle to the longitudinal axis of the hole-forming tool, thereby tending to displace soil upwards or downwards upon rotation.

The enlarged base-forming technique described above may be adapted so as to provide an extended enlarged base. This may be done by continuing to rotate the tool while extracting it slowly through the founding stratum and concomitantly supplying concrete or grout. Once the top of the founding stratum is reached, rotation of the tool is stopped, and withdrawal from the ground completed in the normal way. This results in a pile having an elongate base of wider diameter than the main body of the pile, which may have enhanced skin friction as well as enhanced end bearing capacity.

It is also possible for the enlarged base formation technique to be repeated at several depths within the founding stratum, or even to continue rotation while extracting the tool at a rate which allows a continuous spiral base enlargement to be produced.

A further possibility is to apply a degree of back and forth rotation during extraction of the tool. In this way, a pile having a central body is provided with "wings" defined by the width of the blade-like attachments, which may have enhanced skin effects due to the resulting pile having a greater circumferential surface area than that of a simple cylinder.

The cast-in-situ pile may be provided with an enlarged head at or below the surface of the ground by way of additional rotation of the tool and concomitant additional concrete or grout delivery once the hole-forming tool has been withdrawn to a predetermined level. This enlarged head nay be provided just below the ground surface or at greater depths if a reduction of ground level is expected. In some applications, the enlarged head may be formed in a carpet of gravel or other appropriate granular material which has been provided at the surface level.

Once the pile has been cast, a reinforcement may be inserted. This may take the form of a single or multiple steel bar arrangement which is pushed to a predetermined depth into the wet concrete or grout before this has set.

BRIEF DESCRIPTION OF THE DRAWING

For a better understanding of the present invention and to show how it may be carried into effect, reference will now be made, by way of example, to the accompanying drawings in which.

SPECIFIC DESCRIPTION

Figure 1:
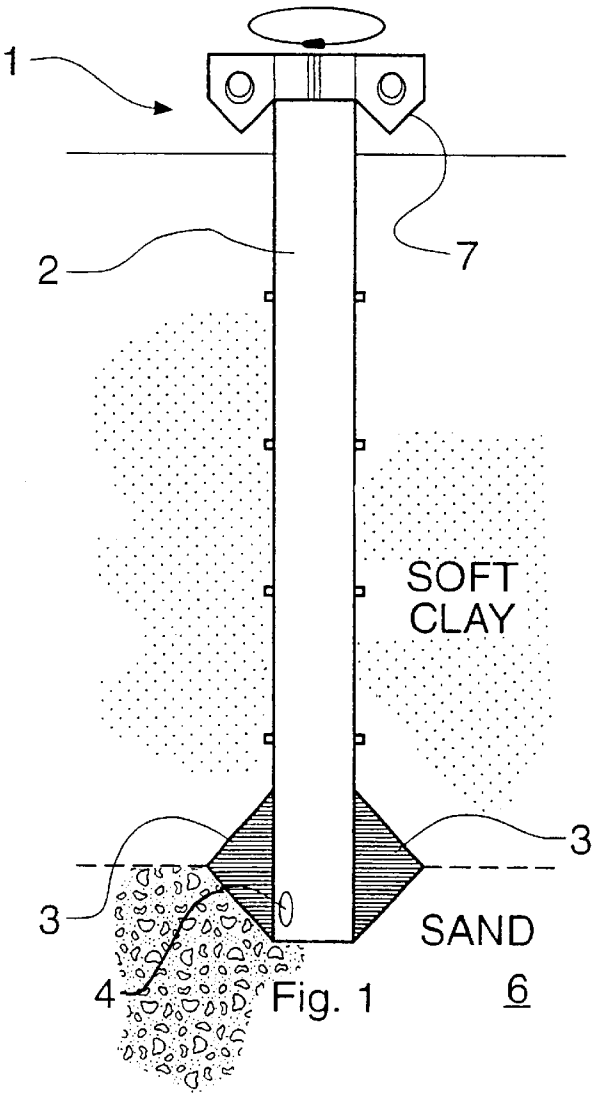
FIG. 1 shows a hole-forming tool of the present invention after it has been pushed into the ground.

The hole-forming tool 1 shown in FIG. 1 comprises a body 2 provided with two blade-like attachments of fins 3 at or near its base. The diameter of the body 1 of the embodiment shown is 0.3 m, and the maximum distance between the extremities of the fins 3 is 0.8 m. The fins 3 are shaped and sized so as to displace a volume of approximately 100 liters when the hole-forming tool 1 is rotated. Furthermore, the fins 3 are provided with slanting edges so as to facilitate insertion and extraction of the hole-forming tool 1. The body 2 of the hole-forming tool 1 is hollow, and allows concrete or grout to be pumped from the top of the hole-forming tool 1 and out through a port 4 provided near the base of the hole-forming tool 1, although in other embodiments a separate grout or concrete feed pipe or pipes may be used.

In use, the hole-forming tool 1 is pushed into soft ground, such as clay 5, in a continuous motion until the base of the hole-forming tool 1 reaches the top of a layer of granular material, rock or bedrock 6. A rotational motion is then applied to the tool, and it is pushed further into the ground. The rotational movement helps the tool to penetrate into the granular material by decreasing the ground pressure around the tip of the tool and allowing material beneath the tip of the tool to migrate upwards into the regions of decreased ground pressure. A vibrator 7 may be mounted to the top of the hole-forming tool 1 in order to aid penetration through any intermediate sand lenses or stiff layers (not shown), as well as to reduce friction and to ensure entry of the base of the hole-forming tool 1 into the sand layler 6. Typically, the force required to insert the hole-forming tool of FIG. 1 will be less than 100 kN with an angle of friction of the soil, say of 30°, for the basal sand.

Once the hole-forming tool 1 has been inserted to the required depth, it is rotated so that the fins 3 displace a volume of soil. At the same time, concrete or grout is pumped through the body 2 of the hole-forming tool 1 arid out through the port 4, thereby forming a subterranean bulb of concrete or grout. The hole-forming tool 1 is then withdrawn without rotation while concrete or grout continues to be pumped so as to form the shaft of a cast-in-situ pile.

Figure 4:
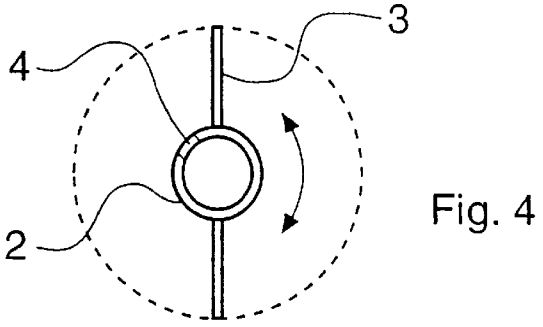
FIG. 4 shows in cross-section a third arrangement of blade-like attachments on the hole-forming tool of FIG. 1.
Figure 3:
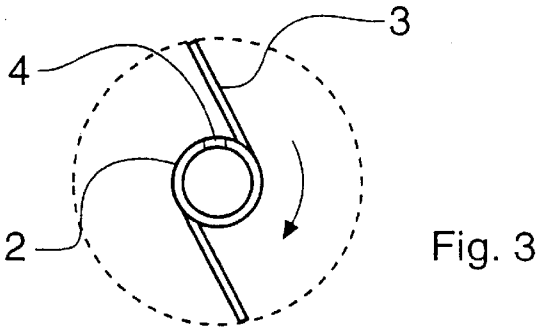
FIG. 3 shows in cross-section a second arrangement of blade-like attachments on the hole-forming tool of FIG. 1.
Figure 2:
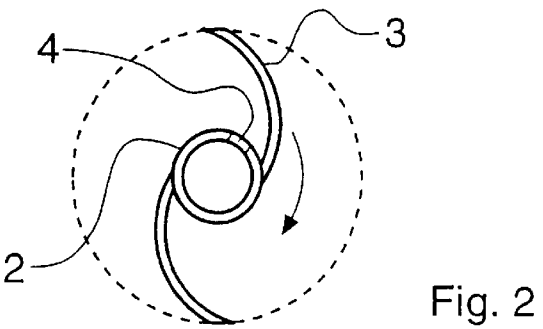
FIG. 2 shows in cross-section a first arrangement of blade-like attachments on the hole-forming tool of FIG. 1.

The fins 3 may take various configurations, examples of which are shown in FIGS. 2, 3 and 4. The configurations of FIG. 2 and 3 are designed for rotation in one direction only, whereas the configuration of FIG. 4 may be rotated in both directions.

The fins 3 need only be thick enough so as not to deform excessively upon rotation. In the illustrated embodiment, no permanent deformation of the fins 3 will occur in clays of up to a clay shear strength typically of 50 kN/mm$^2$ (undrained). In the arrangement shown, the fins 3 span a distance of 0.8 m, thereby increasing the bearing surface area by seven times in relation to the diameter of the hole-forming tool 1, which is 0.3 m.

Figure 5:
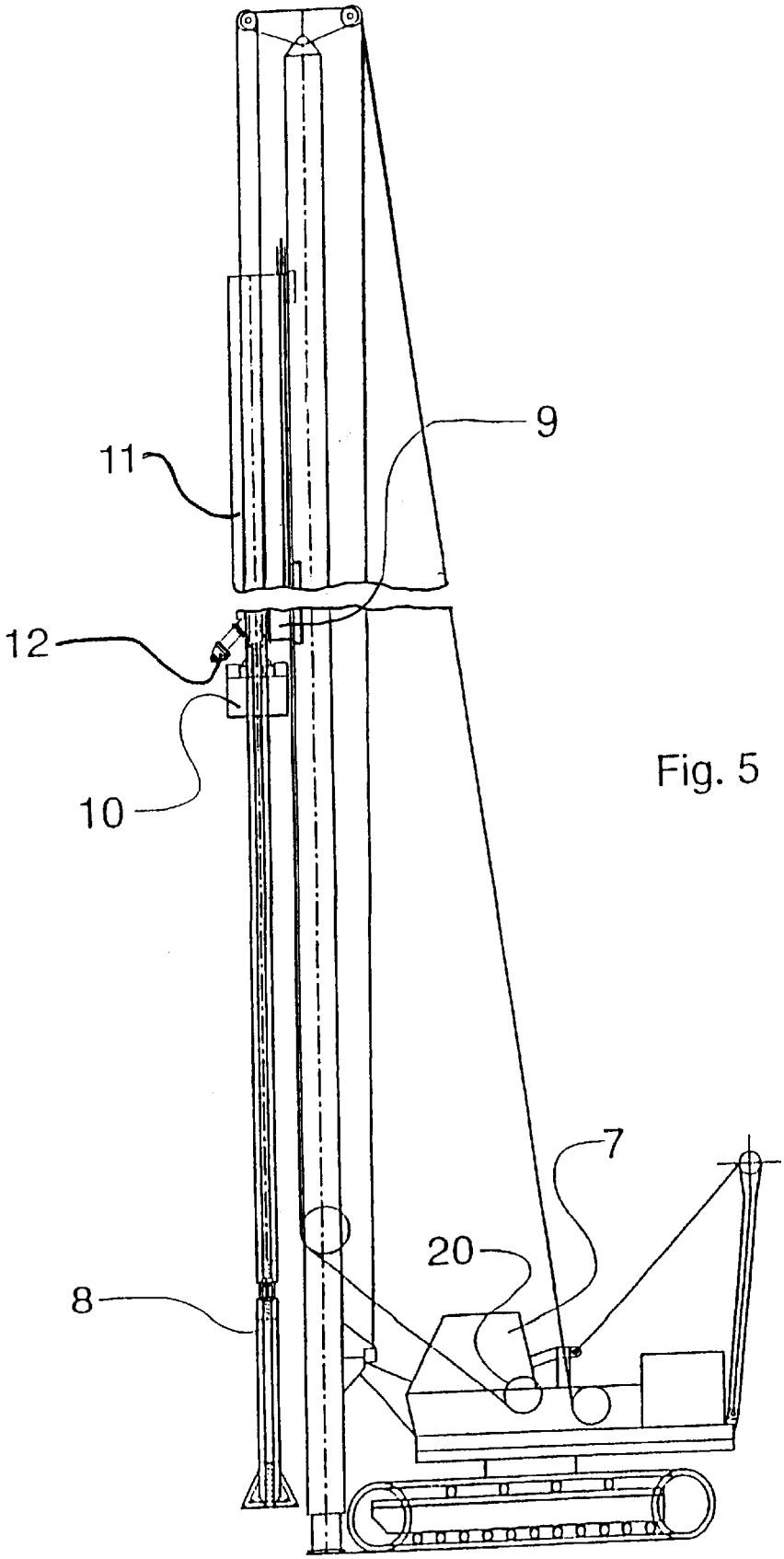
FIG. 5 shows a rig fitted with a hole-forming tool and a suspended weight.

FIG. 5 shows a rig 7 on which is mounted a hole-forming tool 8. At the top of the hole-forming tool 8, there is provided a drive unit 9 to rotate the tool, and a vibrator unit 10. A weight 11 is adjustably suspended over the top of the hole-forming tool 8 such that a downwards force can be applied to the top of the tool in order to push this into the ground in a continuous motion. Instead of or in addition to the weight 11, there may be provided a hydraulic ram 11' as shown i n FIG. 6, which has an extension of at least 1 m, and typically at least 2 m or even 5 m. The ram 11' is used to push the hole-forming tool 8 to a given depth of at least 1 m in a single continuous operation. The ram 11' can then be reset and used to push the hole-forming tool 8 to an even greater depth. There may also be provided a winch arrangement 20 which can be used to pull down the top of the hole-forming tool 8. A concrete or grout feed pipe 12 is located at the top of the hole-forming tool 8 so as to allow concrete or grout to be pumped through the body of the tool.

Figure 6:
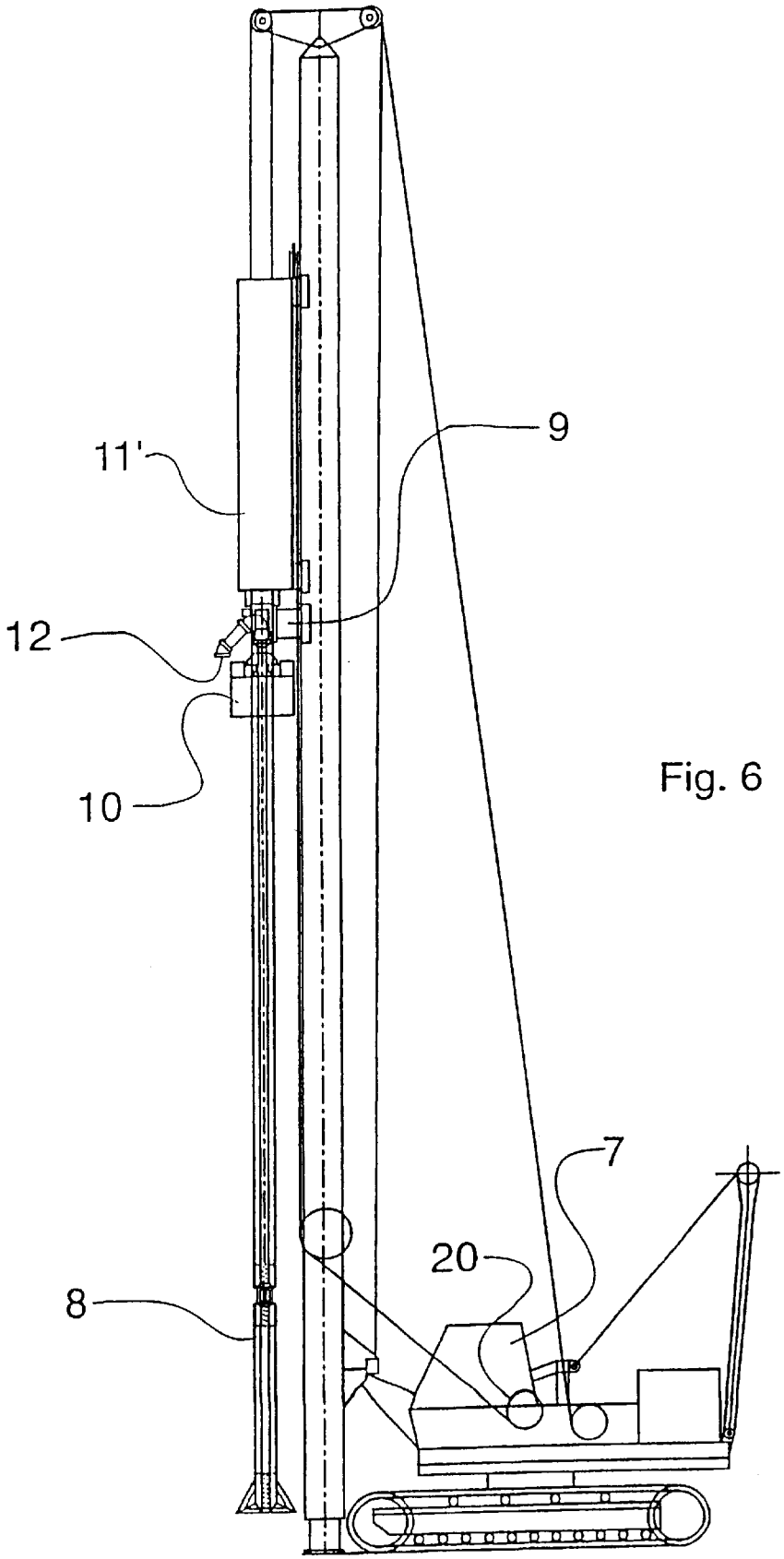
FIG. 6 shows a rig fitted with a hole-forming tool and a hydraulic ram.
Figure 7:
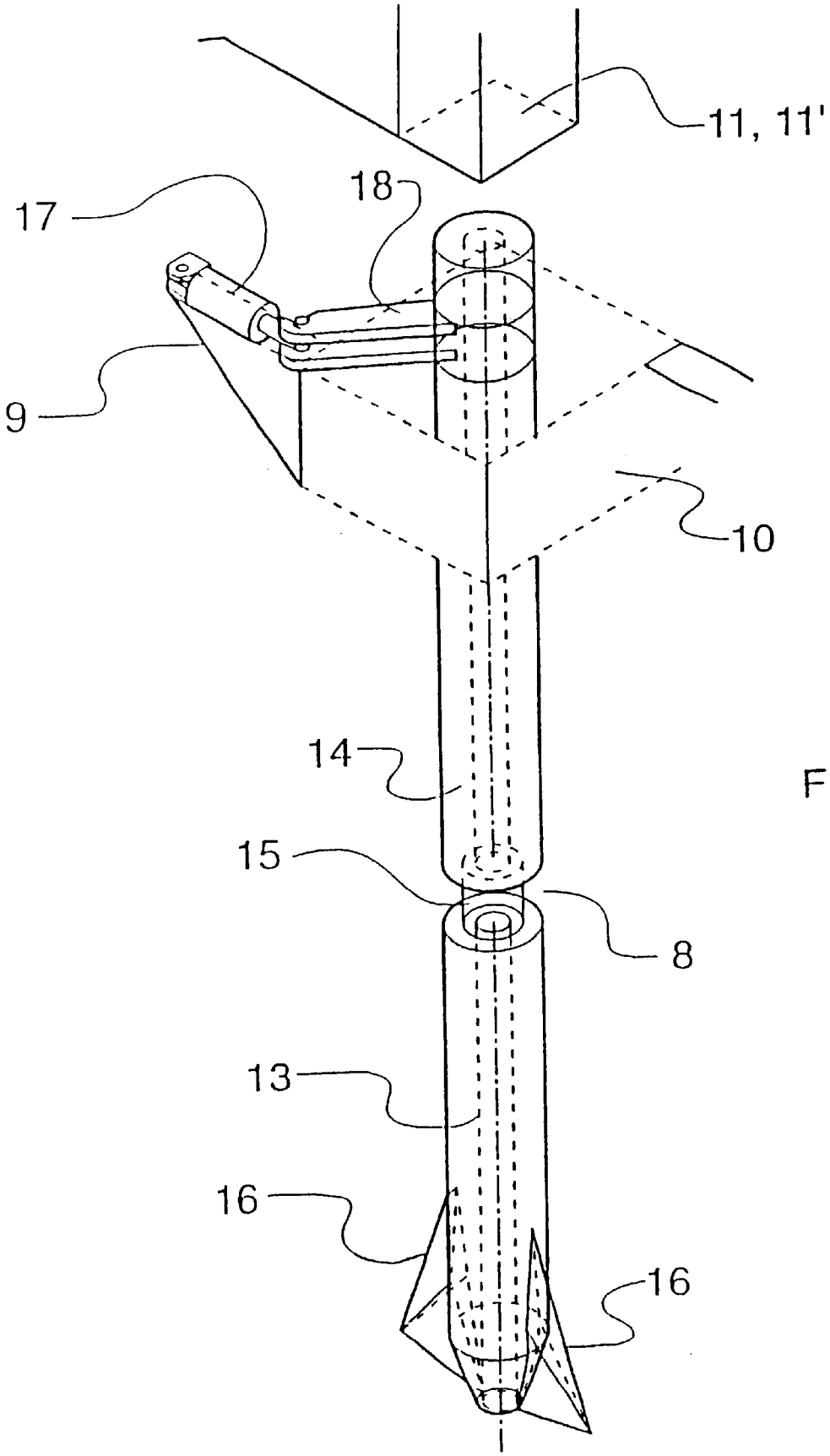
FIG. 7 shows a hole-forming tool in schematic form.

FIG. 7 shows a hole-forming tool 8 similar to that shown in FIGS. 5 and 6. The hole-forming tool 8 has a head portion 13 and a body portion 14, which may be of variable length so as to be adaptable to different ground conditions. The head portion 13 and the body portion are connected by means of a standard connector 15. Two fins 16 are provided towards the lower end of the head portion 13. At the upper end of the body portion 14, where the hole-forming tool 8 is supported by the rig 7, there is provided a vibrator unit 10 and a drive unit 9. The drive unit 9 comprises a ram 17 attached to arms 18 in such a way that actuation of the ram 17 will cause the hole-forming tool 8 to rotate through approximately 90°. A weight 11 is lowered onto the top of the hole-forming tool 8 so as to provide the downwards force required to push the tool into the ground.

Figure 8:
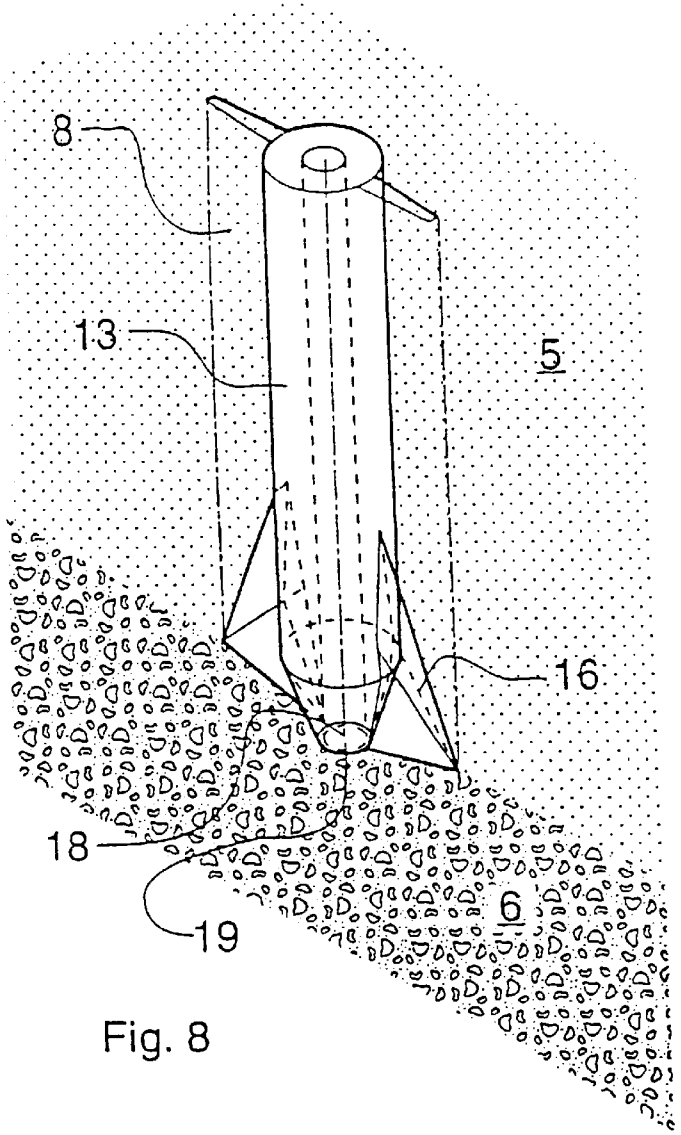

FIG. 8 shows the head portion 13 of the hole-forming tool 8 of FIG. 7 which has been pushed through clay 5 until the tip of the tool has reached the top of a layer of medium dense sand 6. A concrete or grout delivery nozzle 18 is provided at the lower end of the hole-forming tool 8, the nozzle 18 being fitted with a reinforced bung 19 so as to prevent ingress of soil as the hole-forming tool 8 is pushed into the ground.

Figure 9:
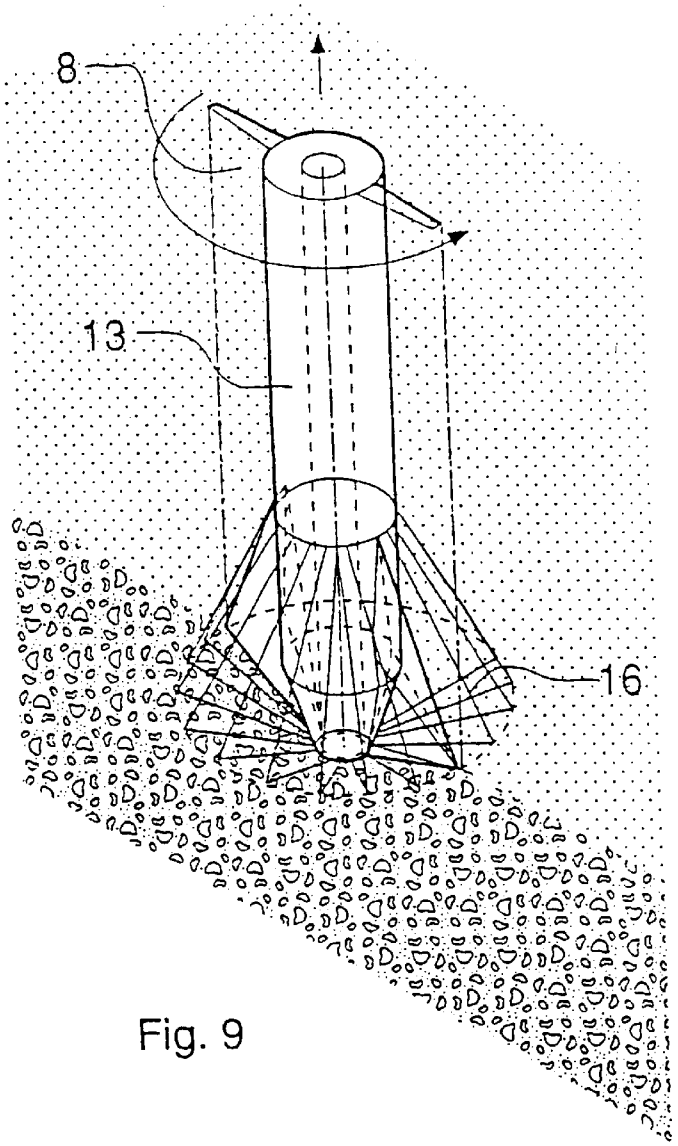
FIGS. 8 and 9 show the hole-forming tool of FIG. 7 in use.

In order to form a pile or load-bearing column, concrete or grout is pumped through the body of the hole-forming tool 8, initially to push out the bung 19. The hole-forming tool is then lifted by approximately 100 mm and concrete or grout is pumped through the nozzle 18 at a controlled rate. The hole-forming tool 8 is then rotated through 180°, as shown best in FIG. 9, such that the fins 16 displace a volume of soil, aided by the pumping of concrete or grout which is concomitantly pumped from the nozzle 18 at a controlled rate. Rotation is then stopped, and the hole-forming tool 8 is withdrawn as concrete or grout continues to be pumped at a rate determined by the rate of withdrawal of the hole-forming tool 8, thereby forming a load-bearing column with an enlarged base, and hence increased bearing capacity. Further enlarged portions may be formed at other points along the length of the load-bearing column by interrupting the withdrawal of the hole-forming tool 8 with further periods of rotation.

Figure 10:
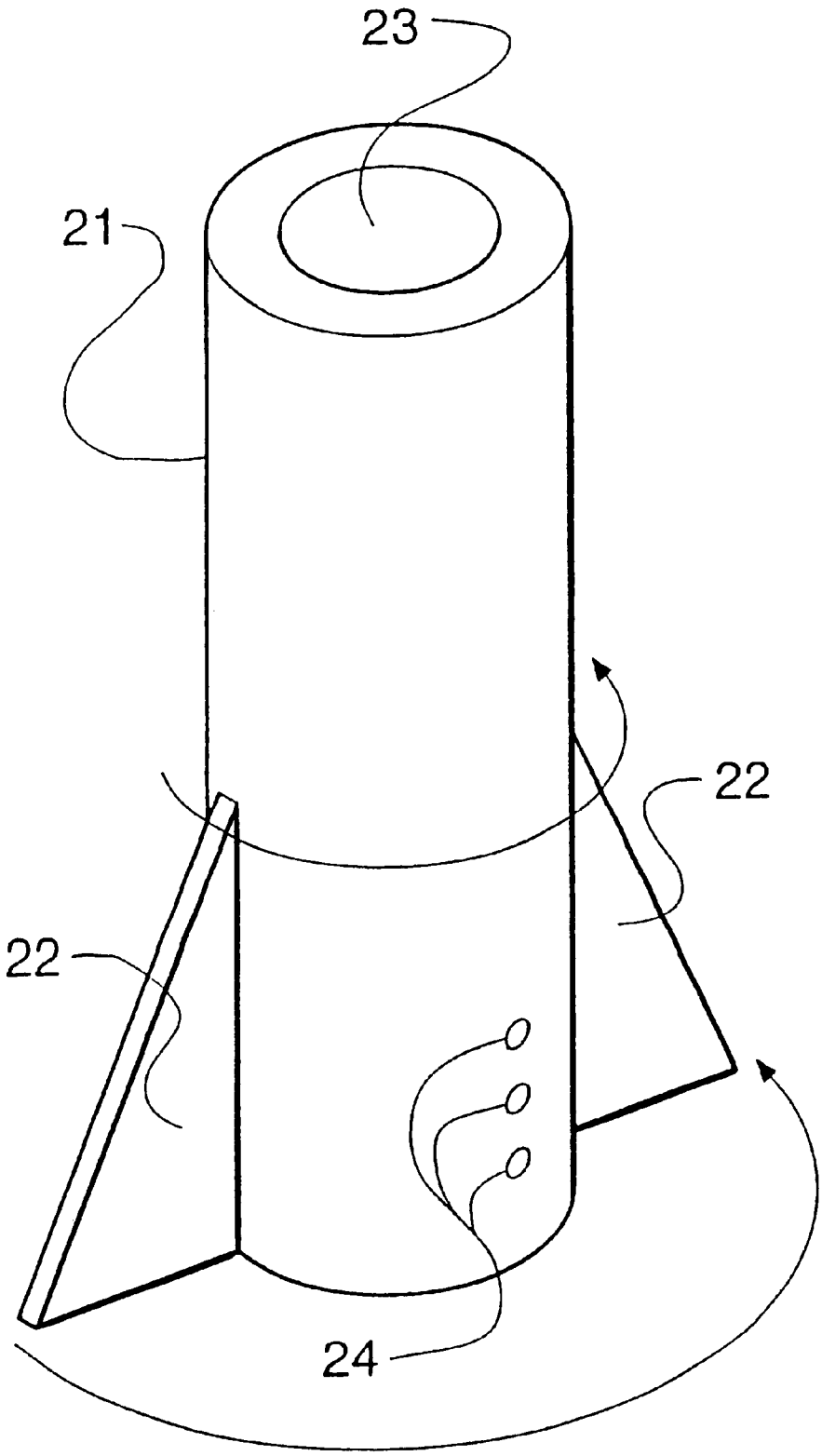
FIG. 10 shows an alternative embodiment of a hole-forming tool of the present invention.
Figure 11:
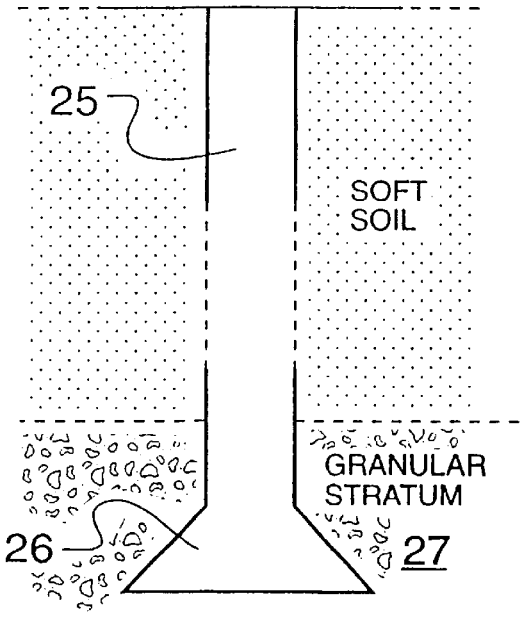
FIG. 11 shows a pile formed by the tool of FIG. 10.

An alternative design of hole-forming tool 21 is shown in FIG. 10. The tool 21 is provided with two fins 22, and has a hollow stem 23 through which concrete or grout may be pumped. Ports 24 are provided behind the fins 22 so as to allow concrete or grout to be output when required. The tool 21 is used in the same manner as the tool 8 of FIGS. 7 to 9, but instead of forming an enlarged pile base on top of a stratum of granular material, the tool 21 is pushed into such a stratum by way of the additional application of rotation. Once the tool 21 has, reached the desired depth, it is then rotated while concrete or grout is pumped through the hollow stem and the ports 4 as described above, before being extracted with no rotation, thereby forming a pile 25 with an enlarged base 26 in a granular stratum 27 as shown in FIG. 11.

Figure 12:
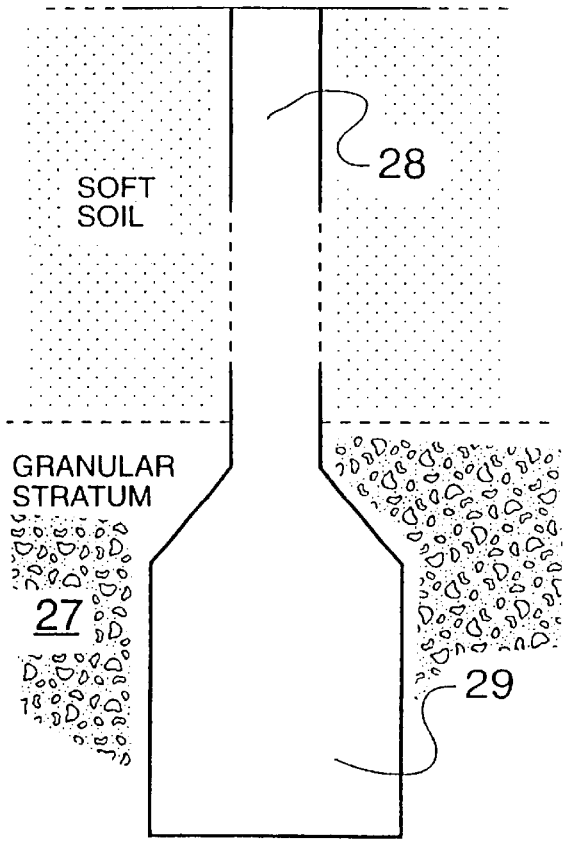
FIGS. 12 to 16 show alternative piles formed by the tool of FIG. 10.

Referring now to FIG. 12, a pile 28 with an elongate cylindrical enlarged base 29 may be formed by continuing to rotate the tool 21 slowly during withdrawal from the granular stratum 27, while continuing to supply concrete or grout. Rotation is then ceased, and the tool 21 withdrawn as before so as to form the main shaft of the pile 28. The elongate cylindrical enlarged base 29 has improved skin friction compared to the simple enlarged base 26 of. FIG. 11.

Figure 13:
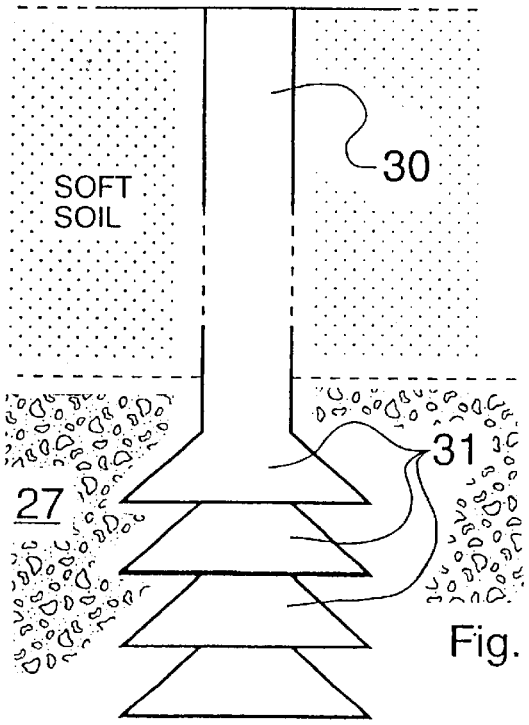
Figure 14:
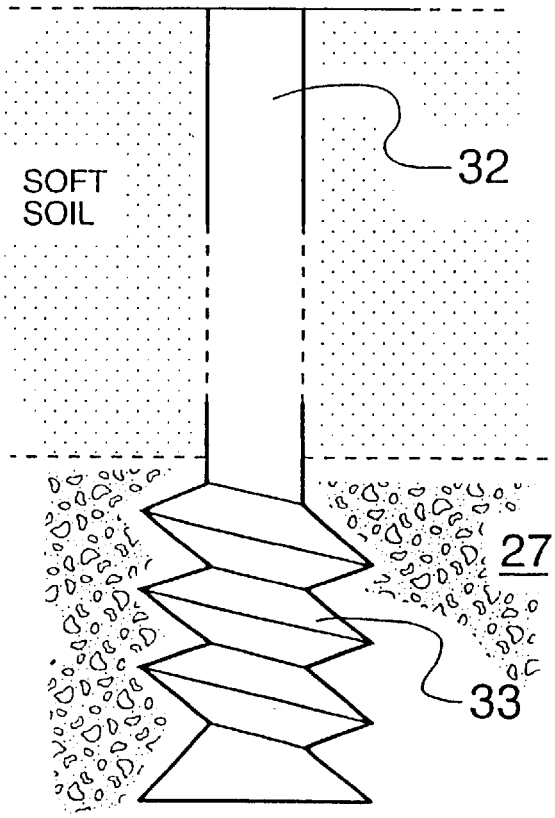

It is also possible, as shown in FIG. 13, to form a pile 30 with multiple enlargements 31. This is achieved by rotating the tool 21 at a base depth while supplying concrete or grout, then ceasing rotation and withdrawing the tool 21 to a higher level before repeating the rotation at that higher level and further levels thereabove. If the tool 21 is rotated continuously while being extracted at a relatively fast rate, or rotated relatively slowly during withdrawal, a pile 32 with a spiral enlargement 33 may be formed, as shown in FIG. 14. The piles 30 and 32 of FIGS. 13 and 14 have increased skin friction and potentially increased end bearing capacity.

Figure 15:
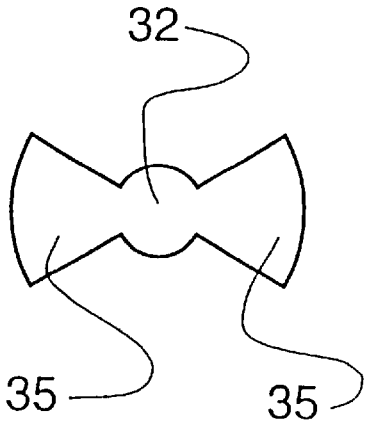
Figure 16:
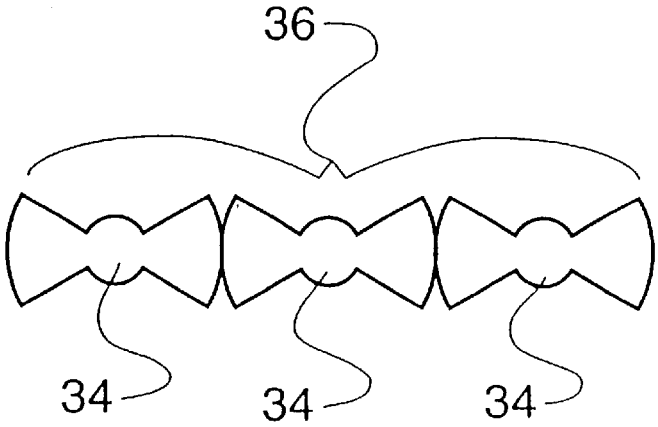

If the tool 21 is given a slight oscillatory rotation during withdrawal, a pile 34 with "wings" 35 may be formed, as shown in section in FIG. 15. These "wings" 35 may extend for the whole length of the pile 34, or may be formed only on sections of the pile length. The increased surface area of such a pile 34 may provide improved skin friction. Furthermore, a. number of such piles 34 may be provided in a row so as to build a subterranean wall 36, as shown in FIG. 16.

What is claimed is:

1. A method of forming an underground cast-in-situ pile, with no extraction of material, using a hollow pile-forming tool comprising a body having a longitudinal axis, aperture means in the region of its lower end, and attached to its lower end, blade means which extend beyond the diameter of the body, the method comprising:

a) pushing the tool non-rotatorily into the ground substantially in the direction of its longitudinal axis, in a substantially non-percussive manner to a first depth;

b) rotating the tool such that the blade means displace soil at or close to the base of the tool, and concomitantly pumping concrete or grout along the length of the tool and through the aperture means so as to assist the blade means in the displacement of soil and generate an enlarged base for the resulting pile; and c) withdrawing the tool while concrete or grout continues to be pumped along the length of the tool.

2. A method according to claim 1 wherein the pushing is by means of a weight which is adjustably suspendible over the tool.

3. A method according to claim 1 wherein the pushing is by means of a hydraulic ram.

4. A method according to claim 1 wherein the pushing is by means of a winch.

5. A method according to claim 1 wherein the tool is rotated in a single direction.

6. A method according to claim 1 wherein the tool is rotated back and forth.

7. A method according to claim 6 wherein a vibrator is used to vibrate the tool about its longitudinal axis.

8. A method according to claim 1 wherein the force directly applied to the top of the tool is greater than any downwards force which may result from rotation of the tool.

9. A method according to claim 8 wherein the force directly applied to the top of the tool is at least twice any downwards force which may result from rotation of the tool.

10. A method according to claim 1 wherein the volume of the concrete or grout supplied is at least equal to the volume of soil displaced by the blade means in the step (b).

11. A method according to claim 1 wherein the concrete or grout is supplied by way of an electronic flowmeter and flow control means.

12. A method according to claim 1 wherein an additional rotation of the tool and concomitant additional concrete or grout delivery is performed once the tool has been substantially fully withdrawn to thereby provide the case-in-situ pile with an enlarged head at or close to the ground surface.

13. A method according to claim 1 wherein the pushing of the tool, the rotation of the tool, the rate of withdrawal of the tool, and the concrete or grout flow rate are monitored and controlled, individually or collectively, by an electronic computer.

14. A method of installing a load-bearing pile or column in the ground, wherein:

a) a hole-forming tool or pile comprising a body having a longitudinal axis and a lower end having blade means attached thereto, the blade means extending beyond the diameter of the body, the tool or pile is pushed into the ground, substantially in the direction of its longitudinal axis, in a substantially non-percussive and non-rotatory manner to an intermediate depth without extraction of material; and b) the tool or pile is then pushed further into the ground, substantially in the direction of its longitudinal axis, in a substantially non-percussive manner while being rotated about its longitudinal axis in such a way that the blade means displace soil at or close to the base of the tool or pile.

15. A method according to claim 14 wherein the tool or pile is pushed by means of a weight which is adjustably suspendible over the tool or pile.

16. A method according to claim 14 wherein the tool or pile is pushed by means of a hydraulic ram.

17. A method according to claim 14 wherein the tool or pile is pushed by means of a winch.

18. A method according to claim 14 wherein the tool or pile is rotated in a single direction.

19. A method according to claim 14 wherein the tool or pile is rotated back and forth.

20. A method according to claim 19 wherein a vibrator is used to vibrate the tool or pile about its longitudinal axis.

21. A method according to claim 14 wherein the force directly applied to the top of the tool or pile is greater than any downwards force which may result from rotation of the tool or pile.

22. A method according to claim 21 wherein the force directly applied to the top of the tool or pile is at least twice any downwards force which may result from rotation of the tool or pile.

23. A method according to claim 14 and as the hole-forming tool, wherein, after the step (b), the tool is withdrawn, and concrete or grout is pumped at positive pressure along the length of the tool and out of a nozzle located at or near the lower end of the tool during withdrawal so as to form a cast-in-situ pile.

* * * * *